US006263582B1

(12) United States Patent
Wade

(10) Patent No.: US 6,263,582 B1
(45) Date of Patent: Jul. 24, 2001

(54) RAZOR WITH SUCTION CUP ATTACHMENT

(76) Inventor: David B. Wade, 2204 Highcrest Dr., Bedford, TX (US) 76022

( * ) Notice: Subject to any disclaimer, the term of this patent is extended or adjusted under 35 U.S.C. 154(b) by 0 days.

(21) Appl. No.: 09/519,341

(22) Filed: Mar. 6, 2000

(51) Int. Cl.[7] ..... B26B 21/04
(52) U.S. Cl. ..... 30/537; 30/298.4
(58) Field of Search ..... 30/298.4, 296.1, 30/526, 537; D28/48

(56) References Cited

U.S. PATENT DOCUMENTS

D. 369,049 * 4/1996 Scaglione .
2,320,374 * 6/1943 Monnet ..... 30/534
4,580,751 * 4/1986 Panzer .
4,644,645 * 2/1987 Audet .
5,730,302 * 3/1998 Groene .
5,839,198 * 11/1998 McCoy .
5,913,317 * 6/1999 Tiram ..... 30/537

FOREIGN PATENT DOCUMENTS

545789 * 6/1942 (GB) ..... 30/FOR 101

* cited by examiner

*Primary Examiner*—Hwei-Siu Payer
(74) *Attorney, Agent, or Firm*—Randol D. Homburg

(57) ABSTRACT

The invention is a razor having multiple suction cups integrated within the handle of the razor, or attached to the razor handle using an elastic sleeve having integrated multiple suction cups, providing a means of attachment of the razor to a flat surface, bath or shower, allowing convenient access and assisting in proper drying of the razor for prolonging the use of the razor.

1 Claim, 2 Drawing Sheets

RAZOR WITH SUCTION CUP ATTACHMENT

CROSS REFERENCE TO RELATED APPLICATIONS

None.

I. BACKGROUND OF THE INVENTION

1. Field of the Invention

The invention is a razor having multiple suction cups integrated within the handle of the razor, or attached to the razor handle using an elastic sleeve having integrated multiple suction cups, providing a means of attachment of the razor to a flat surface, bath or shower, allowing convenient access and assisting in proper drying of the razor for prolonging the use of the razor.

2. Description of Prior Art

The following United States patents are disclosed herein and incorporated into this application for utility patent. All disclosed patents relate to razor accessories and bath accessory devices.

A wet shave razor having an integral holder is disclosed in U.S. Pat. No. 5,839,198 to McCoy, the holder being disclosed as either a singular suction cup attached to the handle of the razor which is not claimed, or extending legs pivoting from the handle holding the razor erect. U.S. Pat. No. 5,730,302 to Groene discloses a wall mounted rack made of a multiple hollow tubes, for containing several razors.

A razor mountable to a can of shaving soap is disclosed in U.S. Pat. No. 4,644,645 to Audet, the mounting means providing a clip incorporated into the handle attaching to the lip of the shaving can. A suction cup mounting means for a shower hose is disclosed in U.S. Pat. No. 4,580,751 to Panzer. A design patent to Scanglione, U.S. Pat. No. D 369,049, shows a design of a suction cup razor holder providing a clip attached to a cradle bracket wherein the head of the razor is placed.

II. SUMMARY OF THE INVENTION

The primary objective of the invention is to provide a means for attaching a razor to a flat surface for access in the bath or shower. A secondary objective is to provide a universal, razor mounting means to allow for proper drying of the razor after use. Two embodiments are provided, a first embodiment having the multiple suction cups integrated into a hollow handle of a typical razor, and a second embodiment providing an elastic sleeve with multiple suction cups to be slipped onto the handle of a razor.

III. DESCRIPTION OF THE DRAWINGS

The following drawings are submitted with this utility patent application.

FIG. 6 is a side view of the second embodiment of the invention.

IV. DESCRIPTION OF THE PREFERRED EMBODIMENT

Figure 1:
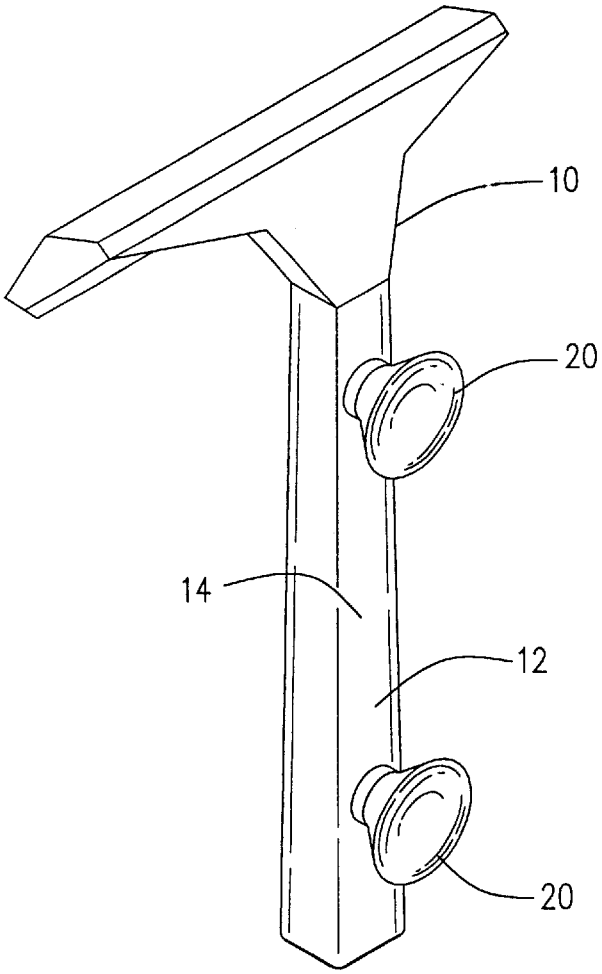
FIG. 1 is a perspective view of the first embodiment.
Figure 2:
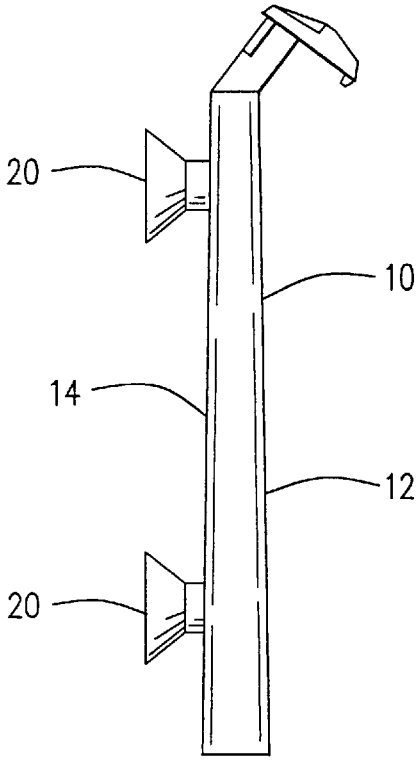
FIG. 2 is a side view of the first embodiment.
Figure 3:
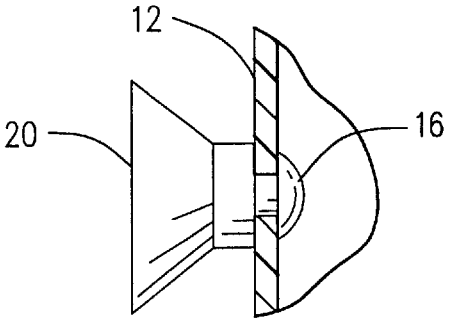
FIG. 3 is a side view of an attaching means of the suction cups in the first embodiment.
Figure 4:
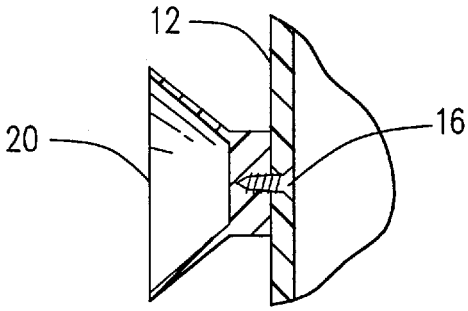
FIG. 4 is a side view of another attaching means of the suction cups in the first embodiment.
Figure 3:
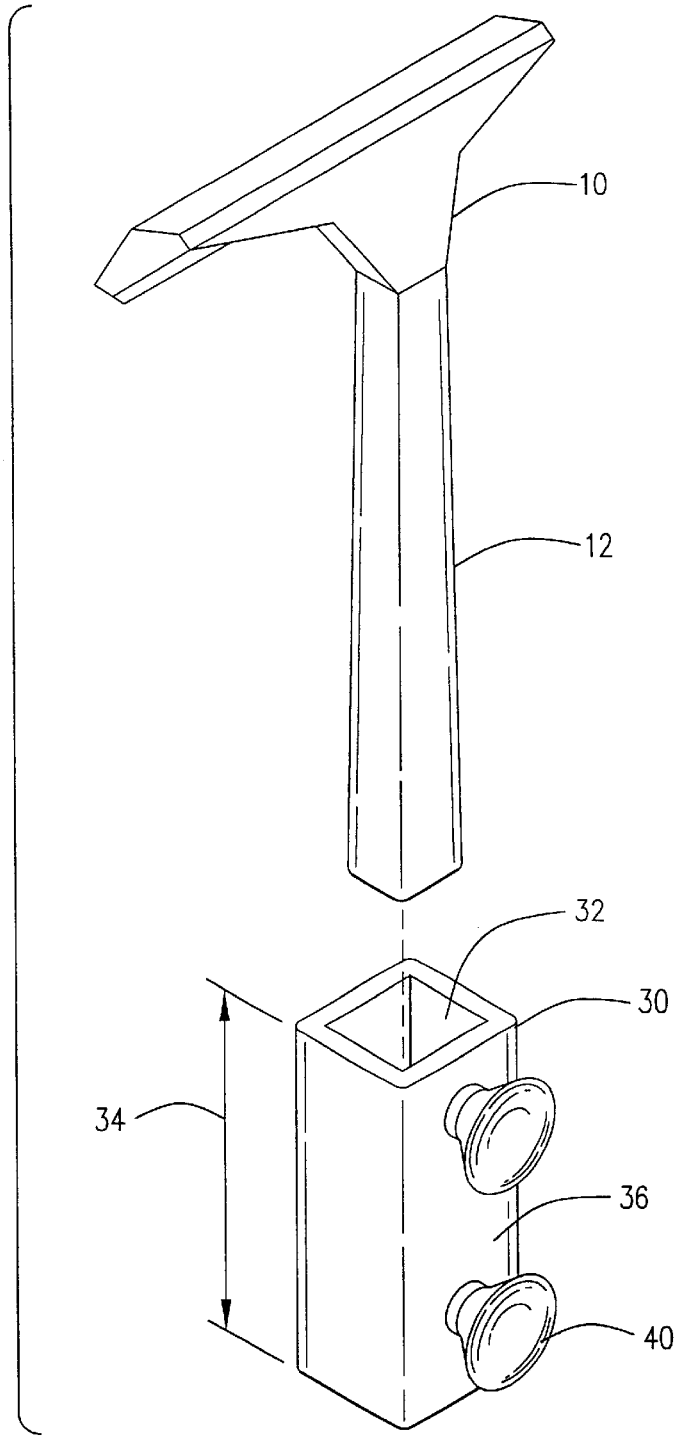

The invention, as shown in FIGS. 1–6 of the drawings, is an improvement to non-electric wet shave razors 10 having a handle 12 and a permanent or replaceable razor head, such head having a razor blade, used in conjunction with shaving foam and water. The improvement, as shown in FIGS. 1–4 of the drawings, comprises a plurality of suction cups 20 attached along the length 14 of the handle 12 by an attaching means 16, thus providing the razor 10 with the ability to be attached to a smooth flat surface, bath or shower. The plurality of suction cups 20 maintains the razor 10 in a fixed and intentionally placed alignment without rotation, and provides a more secure attachment than a singular attachment or single suction cup.

Figure 5:
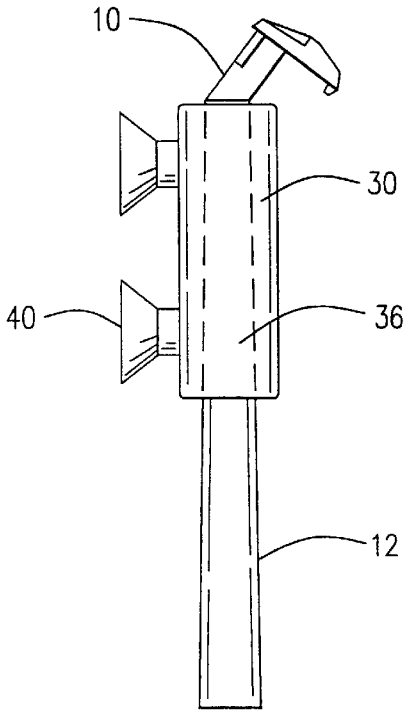
FIG. 5 is a perspective view of the second embodiment of the invention.

A second embodiment of the invention, as shown in FIGS. 5–6 of the drawings, is a device comprising a water-resistant elastic sleeve 30 having an inside 32, a length 34 and an outside 36, to be slipped over and secured to the handle 12 of a non-electric wet shave razor 10. The inside 32 of the elastic sleeve 30 should be of a material that enhances friction between the inside 32 of the elastic sleeve 30 and the handle 12 of the razor 10 to which the elastic sleeve 30 is to be attached. A plurality of suction cups 40 are attached and aligned along the length 34 of the elastic sleeve 30 on the outside 36 of such elastic sleeve 30. This second embodiment may be used and reused on disposable razors, rechargeable blade razors or cartridge blade razors having no surface attaching means, providing such razors 10 with the means for attaching to a smooth flat surface.

While the invention has been particularly shown and described with reference to a preferred embodiment thereof, it will be understood by those skilled in the art that changes in form and detail may be made therein without departing from the spirit and scope of the invention.

What is claimed is:

1. A device for placement on the handle of a non-electric, wet shave razor, the device comprising:

a. a water-resistant elastic sleeve having an inside, a length and an outside, the elastic sleeve made of a material to increase the friction between the razor handle and the inside of the elastic sleeve into which the razor handle is to be inserted; and b. a plurality of suction cups attached along the length of the elastic sleeve to the outside of such elastic sleeve, said suction cups providing attachment of the elastic sleeve and the inserted razor to a smooth flat surface, such device providing the inserted razor with a means of attaching such razor to a smooth flat surface in a fixed and intentionally placed alignment without rotation.

* * * * *